US010746183B2

(12) United States Patent
Ding et al.

(10) Patent No.: US 10,746,183 B2
(45) Date of Patent: Aug. 18, 2020

(54) METHOD FOR MONITORING A SURGE IN A FLUID DEVICE AND REFRIGERATION SYSTEM

(71) Applicant: Carrier Corporation, Farmington, CT (US)

(72) Inventors: Shufu Ding, Shanghai (CN); Xinle Qi, Shanghai (CN); Liang Qian, Shanghai (CN); Michael Alan Stark, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 218 days.

(21) Appl. No.: 15/564,968

(22) PCT Filed: Apr. 7, 2016

(86) PCT No.: PCT/US2016/026356
§ 371 (c)(1),
(2) Date: Oct. 6, 2017

(87) PCT Pub. No.: WO2016/164532
PCT Pub. Date: Oct. 13, 2016

(65) Prior Publication Data

US 2018/0094635 A1 Apr. 5, 2018

(30) Foreign Application Priority Data

Apr. 9, 2015 (CN) ..... 2015 1 0165098

(51) Int. Cl.
*F04D 27/00* (2006.01)
*F04D 27/02* (2006.01)

(52) U.S. Cl.
CPC ..... *F04D 27/001* (2013.01); *F04D 27/02* (2013.01); *F04D 27/0223* (2013.01)

(58) Field of Classification Search
CPC ..... F04D 27/001; F04D 27/02; F04D 27/0223
(Continued)

(56) References Cited

U.S. PATENT DOCUMENTS 6,438,484 B1 8/2002 Andrew et al.
6,532,433 B2 3/2003 Bharadwaj et al.
(Continued)

FOREIGN PATENT DOCUMENTS

CN 88100576 A 8/1988
CN 102224346 A 10/2011
(Continued)

OTHER PUBLICATIONS

Chinese Office Action and Search Report for application CN 201510165098.0, dated Oct. 31, 2018, 11 pages.
(Continued)

*Primary Examiner* — Henry T Crenshaw
(74) *Attorney, Agent, or Firm* — Cantor Colburn LLP

(57) ABSTRACT

A method for monitoring a surge in a fluid device and a refrigeration system. A fluid device is disposed in an operating unit. The method includes providing and displaying a surge line of the fluid device, where the surge line is at least related to a characteristic between fluid pressure and a flow rate of the fluid device; based on preset time intervals, sequentially providing and displaying operating points, of the fluid device in a current operation condition, in a coordinate system to which the surge line belongs, and when a quantity of the provided operating points exceeds a preset value, removing the first provided operating point therein, so that a quantity of the remaining operating points is the preset value; and monitoring a surge status of the fluid device according to relative position relationships between the displayed operating points and the surge line.

4 Claims, 1 Drawing Sheet

(58) Field of Classification Search
USPC ..... 62/127
See application file for complete search history.

(56) References Cited

U.S. PATENT DOCUMENTS

| | | | | |
|---|---|---|---|---|
| 7,841,825 | B2 | 11/2010 | Chen et al. | |
| 8,152,496 | B2 | 4/2012 | White | |
| 8,342,794 | B2 | 1/2013 | Staroselsky et al. | |
| 8,726,678 | B2 | 5/2014 | Turney et al. | |
| 8,749,372 | B2 | 6/2014 | Kong et al. | |
| 2002/0158517 | A1* | 10/2002 | Rouse | F02C 9/18 307/151 |
| 2003/0105535 | A1 | 6/2003 | Rammler | |
| 2008/0098316 | A1* | 4/2008 | Declan | G06F 16/58 715/764 |
| 2010/0198372 | A1 | 8/2010 | Mehta | |
| 2011/0056210 | A1* | 3/2011 | Griffin | F02C 9/18 60/773 |
| 2012/0014812 | A1* | 1/2012 | Blaiklock | F04D 27/001 417/26 |
| 2012/0048387 | A1* | 3/2012 | Galeotti | F04D 27/001 137/14 |
| 2012/0089419 | A1* | 4/2012 | Huster | A61B 5/1115 705/3 |
| 2012/0207622 | A1* | 8/2012 | Ebisawa | F04D 27/001 417/53 |
| 2012/0219431 | A1* | 8/2012 | Sishtla | F04D 27/0246 417/53 |
| 2013/0251503 | A1* | 9/2013 | Park | F04D 27/001 415/1 |
| 2013/0309060 | A1 | 11/2013 | Johnsen | |
| 2014/0026598 | A1* | 1/2014 | Trawicki | F25B 49/00 62/56 |
| 2014/0371919 | A1 | 12/2014 | Creamer | |
| 2015/0219110 | A1* | 8/2015 | De | F04D 27/0246 415/1 |
| 2015/0354464 | A1* | 12/2015 | Hillel | F02C 3/04 415/1 |
| 2018/0094635 | A1* | 4/2018 | Ding | F04D 27/001 |

FOREIGN PATENT DOCUMENTS

| | | | |
|---|---|---|---|
| EP | 2765313 | A1 | 8/2014 |
| JP | S63143400 | A | 6/1988 |
| WO | 2014191051 | A1 | 12/2014 |

OTHER PUBLICATIONS

International Search Report and Written Opinion for application PCT/US2016/026356, dated Jun. 22, 2016, 11 pages.

Zelenov, Alexy, "CCS Implementation of Surge Prevention Control System on Yokogawa Stardom PLC", Yokogawa, Continuous Control Solutions, Jun. 2013, 12 pages.

European Search Report for application EP 16721286.9, dated Jul. 22, 2019, 12 pages.

* cited by examiner

METHOD FOR MONITORING A SURGE IN A FLUID DEVICE AND REFRIGERATION SYSTEM

TECHNICAL FIELD

The present invention relates to the technical field of surge control, and in particular, to a method for monitoring a surge in a fluid device and a refrigeration system, where the fluid device includes, but is not limited to, a centrifugal compressor.

BACKGROUND ART

Many fluid devices such as various types of compressors, pumps, and fans have already been widely applied. However, because of inherent characteristics of these fluid devices, a "surge" phenomenon may occur in an operation process. Once a surge occurs, flowing stability of a medium inside a fluid device will be severely impaired, which not only produces mechanical noise, but also further causes related operating members, pipelines, and device bases to vibrate violently, making damage of components more quicker, and even causing the entire unit to be discarded, thereby leading to hazardous results. Therefore, it is of great significance that an effective measure can be used to effectively monitor, prevent, and avoid a surge in a fluid device in time.

In this aspect, some corresponding solutions have already been provided in the prior art. For example, the patent document Publication No. US2012/0207622A1 discloses a compressor control apparatus and a compressor control method, where an anti-surge valve is controlled according to a control parameter by using a simulation unit, a control parameter adjustment unit, a valve control unit, and a control parameter setting unit, so as to prevent an operating point of the compressor from entering a surge area. For another example, the patent document Publication No. US20130309060 discloses that a vibration monitor device installed on a turbine compressor element is used to provide a vibration signal, thereby detecting a surge event and providing anti-surge control. In addition, many patent documents such as Publication No. U.S. Pat. No. 8,342,794 and Publication No. US20030105535 also relate to various anti-surge control solutions. However, product users, device maintenance personnel, professional technicians and other related people are still in need of an intuitive and effective measure to timely and rapidly grasp a current operation status of a unit device, and history performance data cannot be directly acquired and fully used either; therefore, a system configuration and an operating condition cannot be understood better, and it is unknown how to implement an optimal configuration to prevent and resolve a surge problem.

SUMMARY OF THE INVENTION

In view of this, the present invention provides a method for monitoring a surge in a fluid device and a refrigeration system, thereby effectively resolving the foregoing problems that exist in the prior art and problems in other aspects.

According to a first aspect of the present invention, a method for monitoring a surge in a fluid device is first provided, the fluid device being disposed in an operating unit, where the method for monitoring a surge in a fluid device includes steps:

providing and displaying a surge line of the fluid device, where the surge line is at least related to a characteristic between fluid pressure and a flow rate of the fluid device;

based on preset time intervals, sequentially providing and displaying operating points, of the fluid device in a current operation condition, in a coordinate system to which the surge line belongs, and when a quantity of the provided operating points exceeds a preset value, removing the first provided operating point therein, so that a quantity of the remaining operating points is the preset value; and monitoring a surge status of the fluid device according to relative position relationships between the displayed operating points and the surge line, where the relative position relationships include the operating points being in a surge area and being in a non-surge area, and the surge area and the non-surge area are obtained by dividing the coordinate system by the surge line; or, the relative position relationships include the operating points being in a surge area, being in a non-surge area, and being in a near-surge area, the near-surge area is located between the surge area and the non-surge area, and a distance between a boundary of the near-surge area and the surge line is not greater than a set value.

In the foregoing method for monitoring a surge in a fluid device, optionally, the method for monitoring a surge in a fluid device further includes steps:

when it is monitored that a displayed latest operating point is already in the surge area or the near-surge area, performing anti-surge operation processing, where the anti-surge operation processing includes triggering a surge alarm, turning on an anti-surge control apparatus, increasing the flow rate of the fluid device, adjusting a rotational speed of the fluid device, and turning off the fluid device; and/or at least storing data of all the provided and displayed operating points for a preset period, so as to optimize and adjust at least a part of configuration parameters of the operating unit by querying and analyzing the data, to prevent a surge from occurring in the fluid device.

In the foregoing method for monitoring a surge in a fluid device, optionally, the preset time intervals, and/or the preset value of the quantity of the operating points, and/or the set value are all set in an adjustable manner.

In the foregoing method for monitoring a surge in a fluid device, optionally, the surge line and the operating points are displayed on a display unit that is disposed together with the fluid device or disposed remotely from the fluid device, and the display unit includes a display panel, a computer display, and a display screen of a handheld terminal.

In the foregoing method for monitoring a surge in a fluid device, optionally, on the display unit, the operating points are displayed with different brightness levels in an inversely proportional relationship with a time sequence in which the operating points are provided, and an operating point to be removed therein is removed in a manner of display brightness eventually becoming zero; and/or on the display unit, distinguishable display of the operating points is performed according to the relative position relationships between the operating points and the surge line, and the distinguishable display includes at least one of color, size, shape, and flickering frequency; and/or on the display unit, the latest operating point of the operating points and the rest operating points are displayed in a manner of the distinguishable display.

According to a second aspect of the present invention, a refrigeration system is further provided, a fluid device being disposed in the refrigeration system, where the refrigeration system further includes:

a first unit, configured to provide a surge line of the fluid device, where the surge line is at least related to a characteristic between fluid pressure and a flow rate of the fluid device;

a second unit, configured to: based on preset time intervals, sequentially provide operating points, of the fluid device in a current operation condition, in a coordinate system to which the surge line belongs, and when a quantity of the provided operating points exceeds a preset value, remove the first provided operating point therein, so that a quantity of the remaining operating points is the preset value; and a display unit, connected to the first unit and the second unit, and configured to display the surge line and the operating points when necessary, so as to monitor a surge status of the fluid device according to relative position relationships between the operating points and the surge line, where the relative position relationships include the operating points being in a surge area and being in a non-surge area, and the surge area and the non-surge area are obtained by dividing the coordinate system by the surge line; or, the relative position relationships include the operating points being in a surge area, being in a non-surge area, and being in a near-surge area, the near-surge area is located between the surge area and the non-surge area, and a distance between a boundary of the near-surge area and the surge line is not greater than a set value.

In the refrigeration system, optionally, the refrigeration system further includes:

a control unit, connected to the first unit and the second unit, and configured to: when at least a part of the displayed operating points are already in the surge area or the near-surge area, output an anti-surge operation processing command, where the anti-surge operation processing command includes triggering a surge alarm, turning on an anti-surge control apparatus, increasing the flow rate of the fluid device, adjusting a rotational speed of the fluid device, and turning off the fluid device; and/or a storage unit, connected to the second unit, and configured to at least store data of all the provided and displayed operating points for a preset period, so as to optimize and adjust at least a part of configuration parameters of the operating unit by querying and analyzing the data, to prevent a surge from occurring in the fluid device.

In the refrigeration system, optionally, the preset time intervals, and/or the preset value of the quantity of the operating points, and/or the set value are all set in an adjustable manner.

In the refrigeration system, optionally, the display unit is disposed together with the fluid device or disposed remotely from the fluid device, and the display unit includes a display panel, a computer display, and a display screen of a handheld terminal.

In the refrigeration system, optionally, on the display unit, the operating points are displayed with different brightness levels in an inversely proportional relationship with a time sequence in which the operating points are provided, and an operating point to be removed therein is removed in a manner of display brightness eventually becoming zero; and/or on the display unit, distinguishable display of the operating points is performed according to the relative position relationships between the operating points and the surge line, and the distinguishable display includes at least one of color, size, shape, and flickering frequency; and/or on the display unit, the latest operating point of the operating points and the rest operating points are displayed in a manner of the distinguishable display.

The method for monitoring a surge in a fluid device provided in the present invention has advantages such as that operations are simple, a surge monitoring effect is intuitive and distinct, it is easy to acquire and visually present history performance data, and optimization and configuration of a system are convenient and efficient. Therefore, the method of the present invention is very suitable for wide application to various types of fluid devices such as compressors, pumps, and fans, and especially, to a refrigeration system in which a centrifugal compressor is disposed, so that product users, device maintenance personnel, professional technicians and other related people can be provided with a very intuitive and distinct user interface that are more readily acceptable to them. Therefore, it is easy for them to understand a current operation performance status of a device in real time, and when necessary, to take a corresponding anti-surge measure in time, or to perform better optimization and configuration on the system according to history performance data, so that a surge problem can be effectively prevented from occurring in the device, and safety of a machine device as well as personal and property are fully ensured.

DESCRIPTION OF THE DRAWINGS

The technical solutions of the present invention are further described below in detail with reference to the accompanying drawings and the embodiments; however, it should be known that these accompanying drawings are designed only for the purpose of illustration, and therefore are not used to limit the scope of the present invention.

DETAILED DESCRIPTION OF EMBODIMENTS

First, it should be noted that specific steps, structures, characteristics, advantages, and the like of a method for monitoring a surge in a fluid device and a refrigeration system of the present invention are specifically described below in an exemplary manner. However, all the descriptions are only for illustration, and should not be understood as causing any limit on the present invention. In addition, for any single technical feature described or implied in the example mentioned herein or any single technical feature shown or implied in each accompanying drawing, these technical features (or equivalents thereof) can still be randomly combined or deleted, so that other more embodiments of the present invention that are not directly mentioned herein may be obtained.

Generally speaking, the present invention provides a method for effectively monitoring a surge status of a fluid device disposed in an operating unit. For example, such a fluid device may be typically a vane compressor (especially, a centrifugal compressor), and certainly may also be other types of fluid devices such as pumps and fans. In this type of fluid devices, during operation of the operating unit, mechanical vibrations in an abnormal operating condition may occur when a medium is subject to an actuation effect of periodical suction and discharge, that is, a "surge" phenomenon occurs. For this, a surge can be very effectively prevented from occurring in these fluid devices by using the method for monitoring a surge in a fluid device of the present invention.

Figure 1:
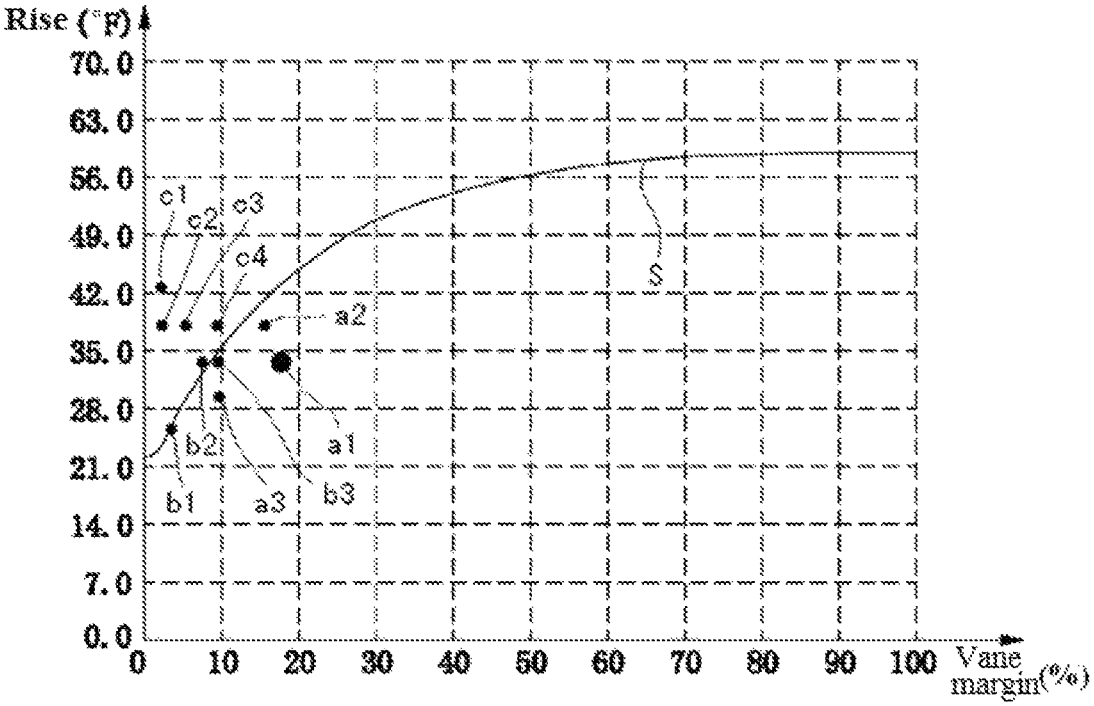
FIG. 1 is an exemplary view of a user interface used in a method for monitoring a surge in a fluid device according to the present invention.

Specifically, referring to FIG. 1, a user interface used in a method for monitoring a surge in a fluid device according to the present invention is schematically shown in the figure. The basic content of the method of the present invention can be basically understood by using the accompanying drawings.

The method for monitoring a surge in a fluid device includes the following steps:

First, a surge line of a fluid device disposed in an operating unit is provided and displayed, and such a surge line is schematically denoted by a symbol S in FIG. 1. In the prior art, many methods for acquiring this type of surge line have already been fully disclosed. For example, the surge line may be acquired according to a characteristic between fluid pressure and a flow rate of the fluid device; or, a series of surge points may be further calculated according to a rotational speed-flow rate-pressure curve provided by a manufacturer of the fluid device, and these surge points are then connected to obtain the surge line; or, this type of surge line may be further obtained by using a characteristic between fluid pressure and a flow rate of the fluid device and in combination with a characteristic of pipeline installation.

For another example, the patent application document International Application No. "PCT/US2012/065194", filed by the applicant on Nov. 15, 2012, and titled "Surge Prevention During Startup Of A Chiller Compressor", discloses related content in aspects such as a surge line, and is incorporated herein by reference in its entirety.

Figure 2:
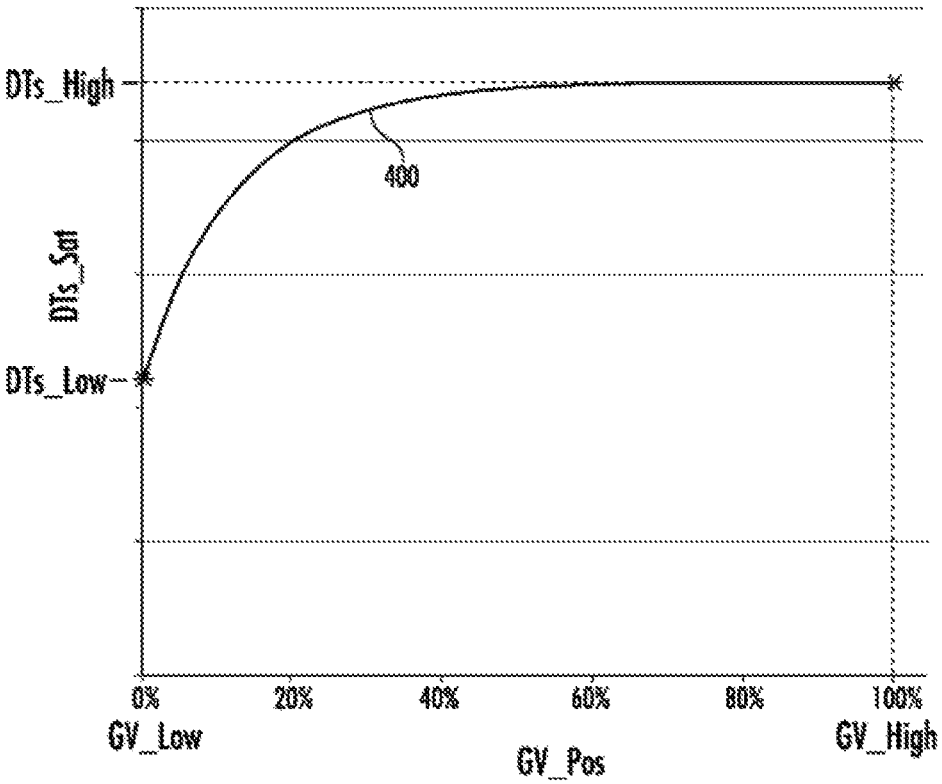
FIG. 2 is a surge line of a compressor drawn according to an existing known manner.

Further specifically, referring to the drawing of the surge line shown in FIG. 2, it is pointed out in the foregoing patent document that each compressor has a unique surge line, which determines an operation area in which the compressor can operate without any surge. As shown in FIG. 2, a surge line 400 extends from a low guide vane position GV_Low to a high guide vane position GV_High, and a rise DTs_High at GV_High and a rise DTs_Low at GV_Low are further shown in the figure. In FIG. 2, a guide vane position GV_Pos is shown on an X-axis. In an ideal system, 0 represents a vane chord perpendicular to an inlet axis and an array axis, whereas 100 represents a vane chord parallel to the foregoing axes. Because of intersecting physical constraints, 0 may represent an orientation of 0°, whereas 100 may represent an orientation of less than 90° from 0. Other grades may be used, where GV_Low and/or GV_High start from 0 and 100. A Y-axis represents a definition of a rise DTs_Sat, that is, a saturation temperature of a condenser in the patent document minus a saturation temperature of a cooler or an evaporator.

It should be particularly noted that the method of the present invention is obviously not necessarily limited to only the foregoing manners to acquire the surge line, and instead, any applicable manner can be used to acquire and provide the surge line of the fluid device in the operating unit.

After the surge line is acquired, next, operating points of the fluid device in the operating unit in current operation condition are sequentially provided according to preset time intervals (for example, an interval of 1 minute, 3 minutes, 45 minutes or any other suitable value), and these operating points are displayed in a coordinate system where a surge line S shown in FIG. 1 is located. In the method of the present invention, to distinctly present information on a display interface to a reader, when a quantity of operating points cumulatively provided exceeds a preset value (for example, 10, 30, 45, 60 or any other suitable value), the first provided operating point therein is removed. In this way, only an expected quantity of operating points may be kept on the display interface, thereby ensuring that a monitoring image is intuitive and distinct and can be easily understood by product users, device maintenance personnel, professional technicians and other related people in a rapid and timely manner.

It may be understood that in the method for monitoring a surge in a fluid device of the present invention, in an optional case, the foregoing preset time intervals for acquiring an operating point may be adjusted and set according to a specific application requirement, and similarly can be flexibly adjusted and set according to the preset value of the quantity of operating points to be kept on the display interface.

Referring to FIG. 1 still, when the surge line and actual operating points of the fluid device in the operating unit are both visually presented on the display interface, the surge status of the fluid device can be monitored and grasped very intuitively and conveniently according to relative position relationships between these operating points and the surge line. The surge status of the fluid device is a condition about whether a surge occurred, whether a surge nearly occurred or whether a surge never occurs in the fluid device currently and over a previous period of time (the period of time is related to the foregoing preset time intervals and the preset value of the quantity of operating points to be kept).

FIG. 1 already exemplarily shows several operating points, and detailed explanation and description may be provided by using the relative position relationships between the operating points and the surge line.

For example, as shown in FIG. 1, in this example, a vane compressor is specified for the fluid device for easy illustration and description. In FIG. 1, an X-axis and a Y-axis respectively represent a vane margin and a rise that are related to the vane compressor. The image may be divided by the surge line S into a surge area and a non-surge area. That is, the area above the surge line S is the surge area in which a surge may occur, and the area below the surge line S is the non-surge area in which a surge does not occur.

As can be clearly seen from FIG. 1, operating points c1, c2, c3, and c4 are in the surge area above the surge line S, which indicates very intuitively and distinctly that at moments corresponding to these operating points above, the exemplarily described vane compressor is already in a state in which a surge may occur. In contrast, operating points a1, a2, and a3 are in the non-surge area below the surge line S, which distinctly indicates that at moments corresponding to the three operating points, the vane compressor is in an operating state in which a surge does not occur.

In addition, FIG. 1 further shows some operating points b1, b2, and b3 that are located near the surge line S. In general, these operating points may be separately categorized in the surge area or in the non-surge area; however, further optionally, a near-surge area located between the surge area and the non-surge area may be further added in the image of the coordinate system where the surge line S is located, so as to further specifically indicate that an adequate alarm should be provided when an operating point falls within the area, because it indicates that a surge problem is very likely to occur in the fluid device. For the near-surge area, the size of the area may be set according to an application demand situation. For example, the near-surge area may be set so that a distance between a boundary thereof and the surge line S is not greater than a set value. The set value may be, for example, 0.5° F., 1.5° F., 2° F. or any other suitable value, and in the method of the present invention, the foregoing set value may be adjusted and set according to a specific need.

In actual applications, in the method for monitoring a surge in a fluid device of the present invention, some steps can be further added in an individual manner or in a combined manner, so that a surge problem can be prevented and resolved in a more desirable manner, and a risk that a surge occurs in the fluid device is minimized or thoroughly eliminated.

For example, in some implementation manners, once it is found through monitoring that a latest operating point is already in the surge area or the near-surge area, corresponding anti-surge operation processing may be performed to solve, in a timely and efficient manner, a surge that already occurs or that is about to occur, so as to reduce or eliminate damages on a machine device and a staff. For example, the used anti-surge operation processing may include, but is not limited to, the following measures: triggering a surge alarm, turning on an anti-surge control apparatus, increasing the flow rate of the fluid device, adjusting a rotational speed of the fluid device, and turning off the fluid device.

For another example, in some implementation manners, data of all the operating points that are already provided and displayed may be stored for an expected preset period as needed, so as to provide the data to people such as product users, device maintenance personnel, and professional technicians for analysis and use, so that these people can query and analyze these data to fully understand an operating condition of the operating unit that includes the fluid device and other related components and pipes. In this way, some configuration parameters of the operating unit may be optimized and adjusted based on the analysis of these structures, which helps to better prevent and stop a surge from occurring in the fluid device, thereby significantly reducing a risk that a surge occurs in the fluid device.

In the method for monitoring a surge in a fluid device of the present invention, the surge line and the operating points of the fluid device are both presented on the display interface, so that a reader can fully understand an operation performance status of a unit device, and timely monitor and avoid the surge occurrence.

For example, the surge line and the operating points may be directly displayed on a display unit that is disposed together with the fluid device, or the surge line and the operating points may be remotely displayed on a display unit that is not disposed together with the fluid device. For example, when the latter manner is used, it may be convenient for professional technicians to perform remote operations and maintenance or provide corresponding technical guidance in other aspects for an on-site device.

It should be further noted that the display unit configured to display a surge line and operating points may be in various forms. For example, the display unit may be a display panel installed in the operating unit (for example, the fluid device), or may be a display of a computer device (for example, a personal computer (PC), a server, and an industrial PC) disposed locally at the operating unit or disposed remotely, or may further be display screens of some handheld terminals (for example, Table PCs, and terminal maintenance machines) that make communication connections in a wired interface manner or in a wireless manner.

In addition, the operating points during operation of the fluid device may be presented in various forms in the method of the present invention, so that not only an objective of visualization is achieved, but also a desirable effect of being clear and distinct can be further implemented. It should be noted that these manners described below may be used in an individual manner or may be used in a combined manner.

For example, these operating points may be respectively displayed with different brightness levels according to a time sequence in which these operating points are provided. In an optional case, an operating point the latest provided may be displayed with the highest brightness, and the relatively earliest operating point kept on the display interface is displayed with the lowest brightness; that is, brightness levels of these remaining operating points are in an inversely proportional relationship with a sequence in which the operating points appear. An operating point that currently has the lowest brightness and is to be removed subsequently is cleared and removed in a manner of display brightness eventually becoming zero. In the method of the present invention, the foregoing manner of gradient display brightness is used, so that it becomes very easy for a reader to clearly monitor and rapidly recognize operation conditions of the fluid device currently and over a previous period of time as well as a development trend of the operation condition, and therefore the reader can comprehensively grasp the latest operation performance of the fluid device or even the entire operating unit and accurately determine a possibility that a surge occurs.

For another example, distinguishable display of the operating points and the surge line may be performed according to the relative position relationships therebetween. For example, the operating points that respectively fall within the surge area, the near-surge area, and the non-surge area may be displayed in a distinguishable manner in aspects such as color, size, shape and/or flickering frequency. For example, the operating points located in the different areas may be respectively displayed in a differentiated manner by using different colors. A standard of choosing and setting specific colors may conform to a conventional habit of people. For example, the operating point such as c1 that is already in the surge area may be marked red, the latest operating point such as a1 that is in the non-surge area may be marked green, and the like, so that a visual display effect of being obvious, intuitive, and readily comprehensible can be achieved. For another example, the operating points that fall within the surge area may all be displayed as red pentagons, the operating points that fall within the near-surge may all be displayed as yellow triangles, and the operating points that fall within the non-surge area may all be displayed as green circles.

For another example, for the latest operating point of the operating points, because it indicates a latest operation condition of the fluid device or even the entire operating unit, it may be considered to perform distinguishable display of the latest operating point and the rest operating points in aspects such as color, size, shape and/or flickering frequency, so as to distinctly remind a reader of paying adequate attention thereto. For example, as shown in FIG. 1, in the given example, distinguishable highlighting display of the latest operating point a1 and other operating points is performed in an aspect of size, so that the latest operating point a1 can be rapidly noticed by people more easily.

Correspondingly, according to a design concept of the present invention, a refrigeration system is further provided. A fluid device is disposed in this refrigeration system.

Therefore, the present invention may be used to effectively prevent and stop a surge from occurring in the fluid device.

Specifically, in an embodiment of the refrigeration system of the present invention, the refrigeration system may include a first unit, a second unit, and a display unit, which are specifically described below.

The first unit is configured to provide a surge line of the fluid device in the refrigeration system, and the second unit is configured to: based on preset time intervals, sequentially provide operating points, of the fluid device in a current operation condition, in a coordinate system to which the surge line belongs, and when a quantity of these operating points exceeds a preset value, remove the first provided operating point therein, so that a quantity of the remaining operating points is the preset value. The display unit is connected to the first unit and the second unit above, so as to display the surge line and the operating points when necessary, so that a user can monitor a surge status of the fluid device by using relative position relationships between the displayed operating points and the surge line.

Reference may be made to the corresponding descriptions above for the content in aspects such as the surge line, the operating points, the preset time intervals, the preset value of the quantity of the operating points, the relative position relationships between the operating points and the surge line, the display unit, and the distinguishable display, which are no longer elaborated due to limited space.

In addition, in an optional case, some other components may be further disposed in the refrigeration system of the present invention, so that the refrigeration system has more usable functions. It should be noted that the present invention completely allows that these added components are optionally disposed in the refrigeration system in an individual manner or in a combined manner.

For example, a control unit may be disposed in the refrigeration system of the present invention. The control unit is connected to the first unit and the second unit. The control unit is configured to: when it is displayed that the latest operating point already falls within a surge area or a near-surge area, output an anti-surge operation processing command. Such an anti-surge operation processing command may include, but is not limited to: triggering a surge alarm, turning on an anti-surge control apparatus, increasing the flow rate of the fluid device, adjusting a rotational speed of the fluid device, and turning off the fluid device.

For another example, a storage unit may be disposed in the refrigeration system of the present invention. The storage unit is connected to the second unit, and is configured to at least store data of all the provided and displayed operating points for a preset period (for example, 24 hours, 48 hours, 72 hours or any other suitable period), so that it becomes convenient for product users, device maintenance personnel, professional technicians and other related people to query and analyze these history performance data to fully understand an operation performance status of a device, so as to perform specific optimization and configuration and more desirable adjustments on some parameters of the entire system, thereby effectively preventing and eliminating in time a surge that is to occur in a device, and reducing a risk of a potential surge; in this way, safety of a machine device as well as personal and property are fully ensured.

The method for monitoring a surge in a fluid device and the refrigeration system of the present invention are described above in detail only by using examples. These individual examples are only used to describe the principle and implementation manners of the present invention, but are not used to limit the present invention. A person skilled in the art may further make various variations and improvements without departing from the spirit and scope of the present invention. For example, although it is mentioned above that operating points are sequentially displayed at preset time intervals, such preset time intervals may be unequal intervals in the present invention. For example, different time intervals may be used for daytime and night time or for working day and non-working day, so as to obtain more desired operating point data, and reduce a storage amount of these data. For another example, although components such as the first unit and the second unit are separately listed above, it should be understood that the division is utterly based on functions, and the present invention allows that in actual applications, the first unit and the second unit are fabricated in one individual electronic device for implementation. Therefore, all equivalent technical solutions should fall within the scope of the present invention and are defined by the claims of the present invention.

The invention claimed is:

1. A method for monitoring a surge in a fluid device, the fluid device being disposed in an operating unit, wherein the method for monitoring a surge in a fluid device comprises:

providing and displaying a surge line of the fluid device, wherein the surge line is at least related to a characteristic between a fluid temperature and a flow rate of the fluid device;

based on preset time intervals, sequentially providing and displaying operating points, of the fluid device in a current operation condition, in a coordinate system to which the surge line belongs, and when a quantity of the provided operating points exceeds a preset value, removing the first provided operating point therein, so that a quantity of the remaining operating points is the preset value; and monitoring a surge status of the fluid device according to relative position relationships between the displayed operating points and the surge line, wherein the relative position relationships comprise the operating points being in a surge area and being in a non-surge area, and the surge area and the non-surge area are obtained by dividing the coordinate system by the surge line;

wherein the surge line and the operating points are displayed on a display unit;

wherein on the display unit, the operating points are displayed with different brightness levels in an inversely proportional relationship with a time sequence in which the operating points are provided, and an operating point to be removed therein is removed in a manner of the display brightness eventually becoming zero.

2. The method for monitoring a surge in a fluid device according to claim 1, wherein the method for monitoring a surge in a fluid device further comprises:

when it is monitored that at least a part of the displayed operating points are already in one of the surge area and a near-surge area located between the surge area and the non-surge area, performing anti-surge operation processing, wherein the anti-surge operation processing comprises one or more of triggering a surge alarm, increasing the flow rate of the fluid device, adjusting a rotational speed of the fluid device, and turning off the fluid device.

3. The method for monitoring a surge in a fluid device according to claim 1, wherein at least one of the preset time intervals, the preset value of the quantity of the operating points, and a set value are all set in an adjustable manner.

4. The method for monitoring a surge in a fluid device according to claim 1, wherein the display unit comprises at least one of a display panel, a computer display, and a display screen of a handheld terminal.

* * * * *